US010362878B2

(12) United States Patent
Murphy

(10) Patent No.: US 10,362,878 B2
(45) Date of Patent: Jul. 30, 2019

(54) FOLDABLE SOFA-BED

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 240 days.

(21) Appl. No.: 15/226,517

(22) Filed: Aug. 2, 2016

(65) Prior Publication Data

US 2017/0071353 A1 Mar. 16, 2017

Related U.S. Application Data

(60) Provisional application No. 62/217,292, filed on Sep. 11, 2015.

(51) Int. Cl.
*A47C 17/17* (2006.01)
*A47C 17/175* (2006.01)
*A47C 17/165* (2006.01)

(52) U.S. Cl.
CPC ..... *A47C 17/1756* (2013.01); *A47C 17/165* (2013.01)

(58) Field of Classification Search
CPC ..... A47C 17/17; A47C 17/13; A47C 17/02
USPC ..... 5/42, 28–29, 12.1
See application file for complete search history.

(56) References Cited

U.S. PATENT DOCUMENTS

| | | | | |
|---|---|---|---|---|
| 709,333 | A * | 9/1902 | Kragen | A47C 17/1655 5/44.1 |
| 2,740,131 | A * | 4/1956 | Vogel | A47C 17/2076 5/309 |
| 4,200,941 | A | 5/1980 | Gill et al. | |
| 5,195,194 | A | 3/1993 | Bradley et al. | |
| 6,588,837 | B1 * | 7/2003 | Schultz | A47C 17/165 297/111 |
| 7,549,182 | B2 | 6/2009 | Murphy | |
| 8,438,676 | B2 | 5/2013 | Murphy | |
| 8,997,273 | B2 | 4/2015 | Murphy et al. | |

* cited by examiner

*Primary Examiner* — Frederick C Conley
(74) *Attorney, Agent, or Firm* — Myers Bigel, P.A.

(57) ABSTRACT

A seating unit that includes a foldable bed includes: a base with an internal cavity; a foldable bed that includes separate and distinct head, intermediate and seat sections; and a bed folding mechanism. In a folded position, the intermediate and seat sections are generally horizontally disposed and positioned in vertically stacked relationship, and the head section is generally vertically disposed and positioned adjacent a rear portion of the base, with an outer surface of a cushion of the head section forming the rear surface of the seating unit, and in an unfolded position, the head, intermediate and seat sections are generally horizontally disposed and in serial alignment with each other. The bed folding mechanism is attached to the base and the head, intermediate and seat sections and controls the movement of the bed between the folded and unfolded positions.

12 Claims, 7 Drawing Sheets

FOLDABLE SOFA-BED

RELATED APPLICATION

The present application claims priority from and the benefit of U.S. Provisional Patent Application No. 62/217,292, filed on Sep. 11, 2015, the disclosure of which is hereby incorporated herein in its entirety.

FIELD OF THE INVENTION

The present invention relates generally to furniture, and more specifically a furniture unit that is convertible into a bed.

BACKGROUND OF THE INVENTION

Furniture units that are convertible into beds are popular with consumers because of their multifunctionality. Many consumers find it very convenient to have a sofa or chair that can provide a bed for a guest, as such a unit can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other furniture units lack a complete mattress, but instead are constructed of separate sections that serve as support surfaces of the sofa and unfold to form a flat, mattress-like sleeping surface. Different examples of this basic concept are shown in U.S. Pat. No. 2,740,131 to Vogel et al., U.S. Pat. No. 5,195,194 to Bradley, U.S. Pat. No. 7,547,182 to Murphy, and U.S. Pat. No. 8,438,676 to Murphy, the disclosure of each of which is hereby incorporated herein in its entirety. The bed shown in the latter of the Murphy patents includes three separate sections that serve as the mattress of the bed: a seat section; an intermediate section; and a head section. A folding mechanism controls the movement of the head, intermediate and seat sections between a folded position, in which the head, intermediate and seat sections are positioned in a vertically stacked relationship, with the head section below the intermediate section and the seat section above the intermediate section, and with the head and intermediate sections being positioned in the cavity of the housing and the seat section serving as the "seat" for the sofa, and an unfolded position, in which the head, intermediate and seat sections are horizontally disposed and serially aligned to form a sleeping surface.

In spite of the existence of these different foldable beds, it may be desirable to offer additional furniture units that can house foldable beds.

SUMMARY

As a first aspect, embodiments of the invention are directed to a seating unit that includes a foldable bed. The seating unit comprises: a base with an internal cavity; a foldable bed that includes separate and distinct head, intermediate and seat sections; and a bed folding mechanism. In a folded position, the intermediate and seat sections are generally horizontally disposed and positioned in vertically stacked relationship, and the head section is generally vertically disposed and positioned adjacent a rear portion of the base, with an outer surface of a cushion of the head section forming the rear surface of the seating unit, and in an unfolded position, the head, intermediate and seat sections are generally horizontally disposed and in serial alignment with each other. The bed folding mechanism is attached to the base and the head, intermediate and seat sections and controls the movement of the bed between the folded and unfolded positions.

As a second aspect, embodiments of the invention are directed to a seating unit that includes a foldable bed, the seating unit comprising: a base with an internal cavity; a foldable bed that includes separate and distinct head, intermediate and seat sections, and a bed folding mechanism. In a folded position, the intermediate and seat sections are generally horizontally disposed and positioned in vertically stacked relationship, and the head section is generally vertically disposed and positioned adjacent a rear portion of the base, with a rear surface of the head section forming the rear surface of the seating unit, and in an unfolded position, the head, intermediate and seat sections are generally horizontally disposed and in serial alignment with each other. The bed folding mechanism is attached to the base and the head, intermediate and seat sections and controls the movement of the bed between the folded and unfolded positions. The head section pivots about a single pivot axis in moving between the folded and unfolded positions, and the intermediate section pivots about a single pivot axis in moving between the folded and unfolded positions.

DETAILED DESCRIPTION OF EMBODIMENTS OF THE INVENTION

Figure 1:
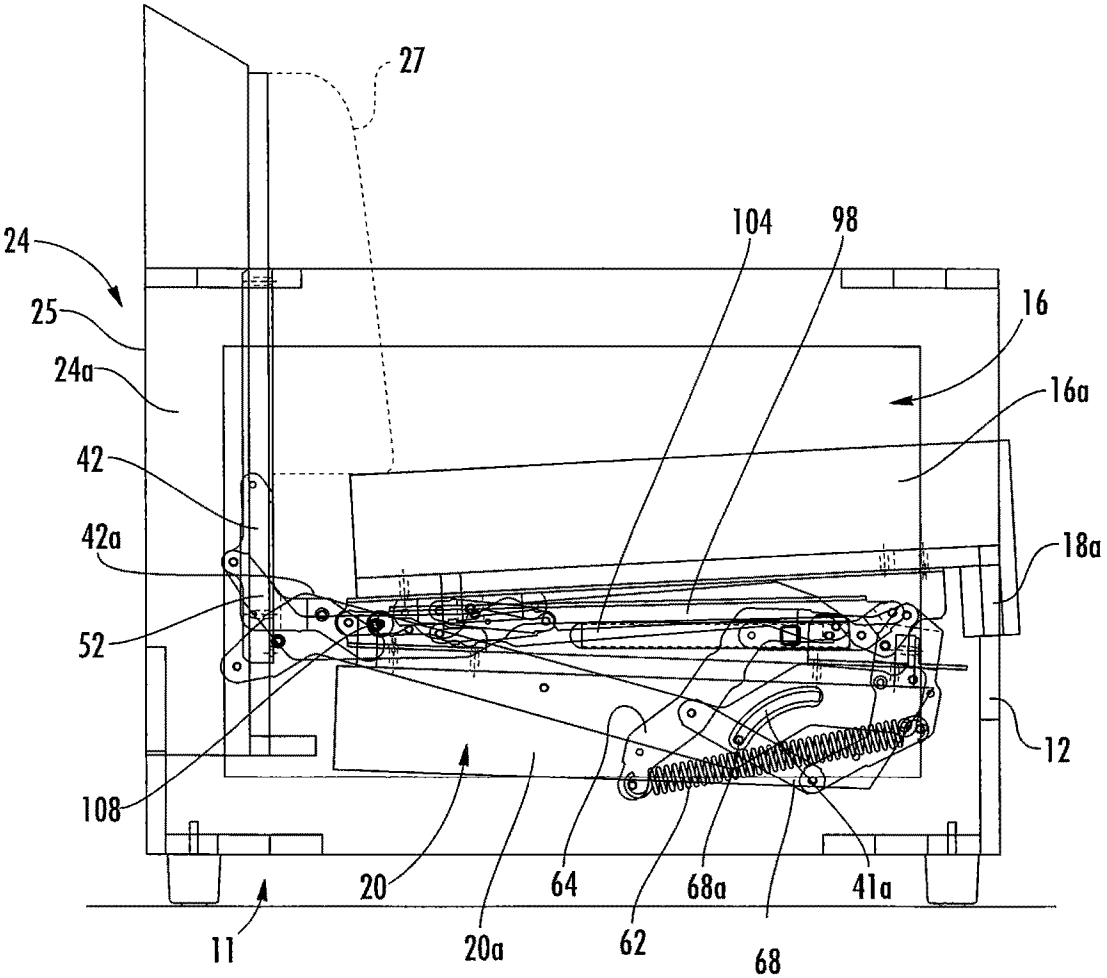
FIG. 1 is a side view of a seating unit according to embodiments of the present invention, with the bed shown in its folded position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Figure 2:
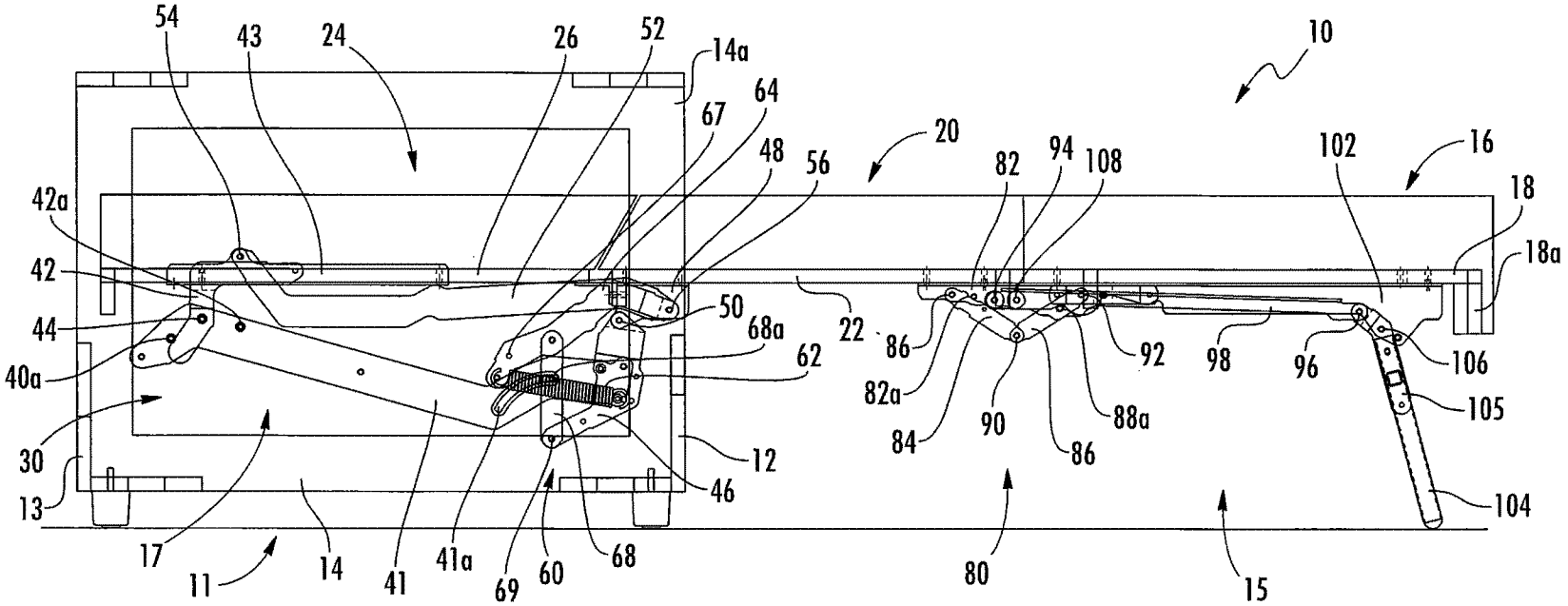
FIG. 2 is a side view of the seating unit of FIG. 1 with the bed in its unfolded position.
Figure 3:
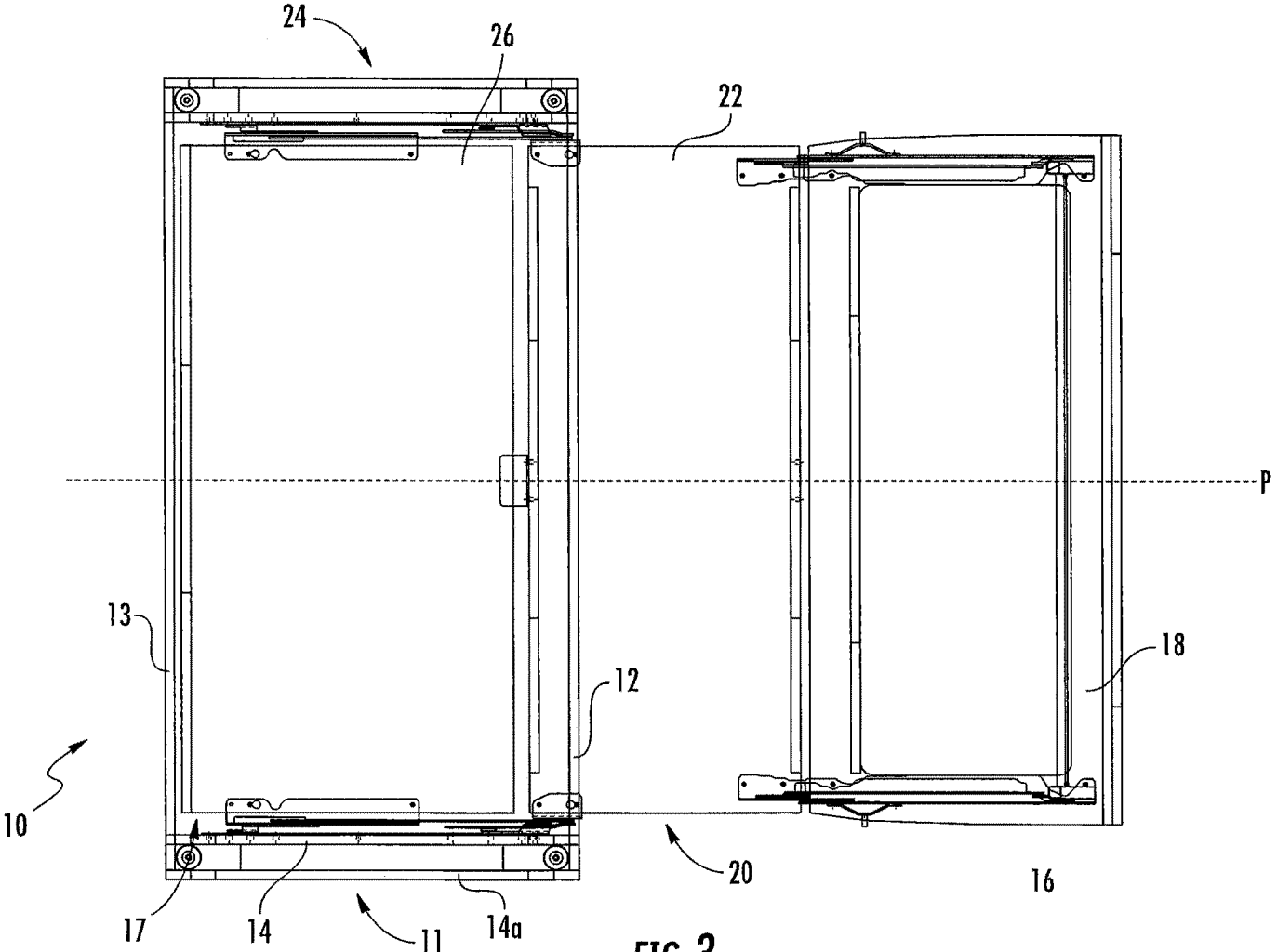
FIG. 3 is a top view of the seating unit of FIG. 1 with the bed in the unfolded position of FIG. 2.

Referring now to the figures, a seating unit, designated broadly at 10, is illustrated in FIGS. 1-3. Referring first to FIGS. 1 and 3, the seating unit 10 includes a base 11 having a front wall 12, a rear cross-brace 13, and opposed side walls 14 with arms 14*a* (see FIG. 3); the walls 12, 14 and the cross-brace 13 define a cavity 17. A foldable bed 15 includes a seat section 16 having a cushion 16*a* with an underlying seat panel 18, an intermediate section 20 having a cushion 20*a* with an underlying intermediate panel 22, and a head section 24 having a cushion 24*a* with an underlying head panel 26. The seat, intermediate and head panels 18, 22, 26 are planar panels, typically formed of wood, that underlie most or all of cushions 16*a*, 20*a*, 24*a* that provide a comfortable surface for sleeping. In other embodiments, the seat panel 18 may comprise two open square subframes and is described in some detail in co-assigned and co-pending U.S. patent application Ser. No. 13/900,311, filed on May 22, 2013, the disclosure of which is hereby incorporated herein in its entirety.

The bed 15 is movable between a folded position, in which the seat and intermediate sections 16, 20 are generally horizontally disposed and positioned in vertically stacked relationship, and the head section 24 is generally vertically disposed (e.g., between vertical and 15 degrees to vertical) and positioned adjacent and just above the rear cross-brace 13, with the outer surface 25 of the head section cushion 24*a* forming the rear surface of the seating unit 10 (see FIG. 1), and an unfolded position, in which the seat, intermediate and head sections 16, 20, 24 are horizontally disposed and serially aligned to form a sleeping surface (see FIGS. 2 and 3).

The movement of the sections 16, 20, 24 of the bed 15 is controlled by a pair of bed folding mechanisms 30, which will be described in greater detail below. The bed folding mechanisms 30 are mirror images of each other about a vertical plane P (FIG. 3) that bisects the seating unit 10 normal to the front wall 12; as such, only one bed folding mechanism 30 will be described herein, with the understanding that the description is applicable to the other mechanism also. Two leg folding mechanisms 80 are also mirror images of each other about the plane P, such that only one will be described in detail hereinbelow.

For the sake of clarity, the bed 15 will be described initially in the unfolded position of FIGS. 2, 3, 5 and 7; movement to the folded position of FIGS. 1, 4 and 6 will then follow. As used herein to describe the relative positions of components, the terms "lateral", "outward" and derivatives thereof indicate the directions defined by a vector beginning at the vertical plane P that bisects the seating unit 10 normal to the front wall 12 and extending toward either side wall 14. Conversely, the terms "inward", "inboard" and derivatives thereof indicate the direction opposite the "outward" direction. Together, the "inward" and "outward" directions comprise the "transverse" axis of the seating unit 10. The "rear" of the unfolded bed 15 is located at the end of the bed 15 nearest the rear cross-brace 13 of the base 11 (i.e., toward the head section 24), and the "front" of the bed 15 is located at the end nearest the seat section 16. The "front" and "rear" directions comprise the "longitudinal" axis of the bed 15.

In addition, some components of the bed folding mechanisms 30 and the leg folding mechanisms 80 are illustrated herein as a series of pivotally interconnected links. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Figure 5:
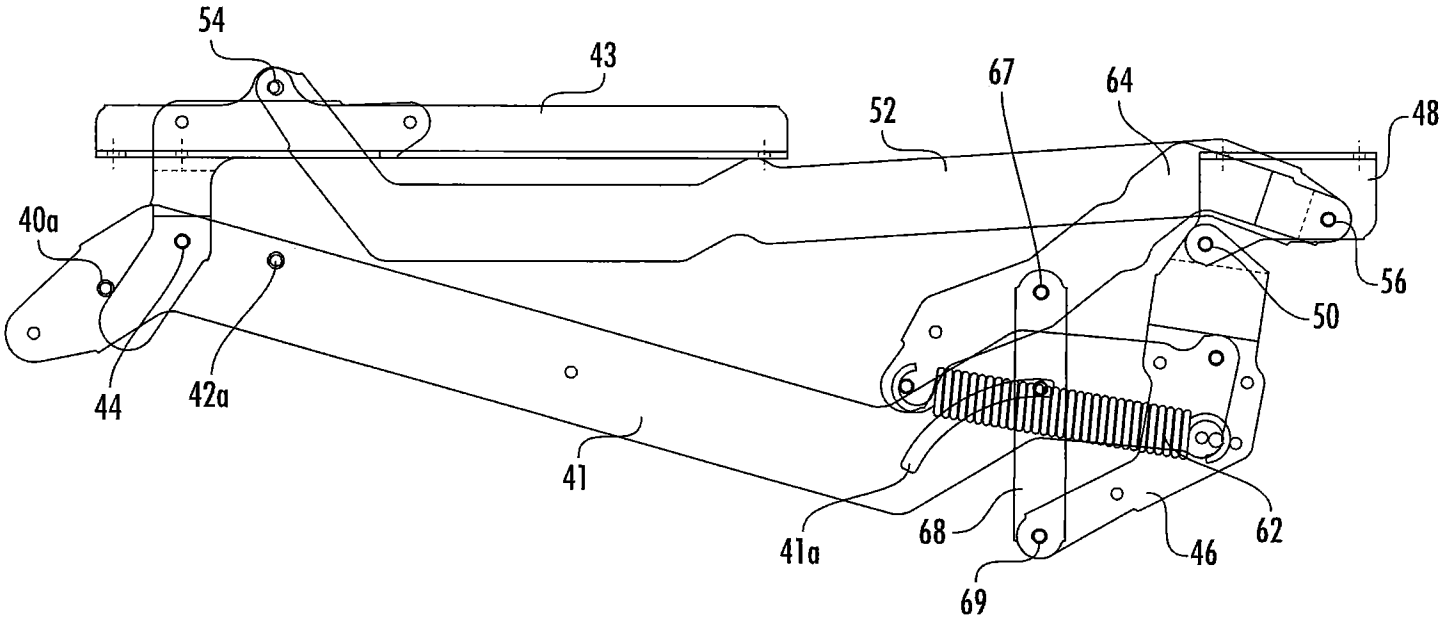
FIG. 5 is a side view of the bed folding mechanism of the seating unit of FIG. 1 in the unfolded position.

Referring now to FIGS. 2 and 5, the bed folding mechanism 30 includes a mounting bracket 41 that is fixed to the inner surface of the side wall 14. An L-shaped head section link 42 is connected to the mounting bracket 41 at a pivot 44; the head section link 42 extends upwardly from the pivot 44, then forwardly, where it is fixed to a head section bracket 43 that is in turn fixed to the lateral edge of the head panel 26. The pivot 44 provides an axis about which the head section 24 rotates in moving between the folded and unfolded positions.

The mounting bracket 41 includes an arcuate slot 41*a*. An angled extension 46 is mounted generally vertically to the forward end of the mounting bracket 41. An intermediate section bracket 48 is fixed to the underside of the intermediate panel 22 and is attached to the upper end of the extension 46 at a pivot 50. The pivot 50 defines an axis about which the intermediate section 20 rotates in moving between the folded and unfolded positions.

A connecting link 52 is attached to the head section link 42 at a pivot 54 and extends forwardly therefrom to a pivot 56 with the intermediate section bracket 48. The connecting link 52 ties together the movements of the head section 24 and the intermediate section 20 in moving between the folded and unfolded positions.

Still referring to FIGS. 2 and 5, the seating unit 10 includes an unfolding assist assembly 60 that can assist the user in unfolding the bed 15. The unfolding assist assembly 60 includes a spring 62 that is attached at its forward end to the vertex of the extension 46. A spring link 64 is attached at its forward end to the intermediate section bracket 48 at the pivot 56 and extends downwardly and rearwardly to attach to the rear end of the spring 62. A control link 68 is attached to the lower end of the extension 46 at a pivot 69 and extends upwardly to a pivot 67 with the spring link 64. The control link 68 also includes a pin 68*a* that is received in the forward end of the slot 41*a* of the front mounting bracket 41. In the unfolded position of FIGS. 2, 3 and 5, the spring 62 is substantially, if not entirely, relaxed.

Figure 7:
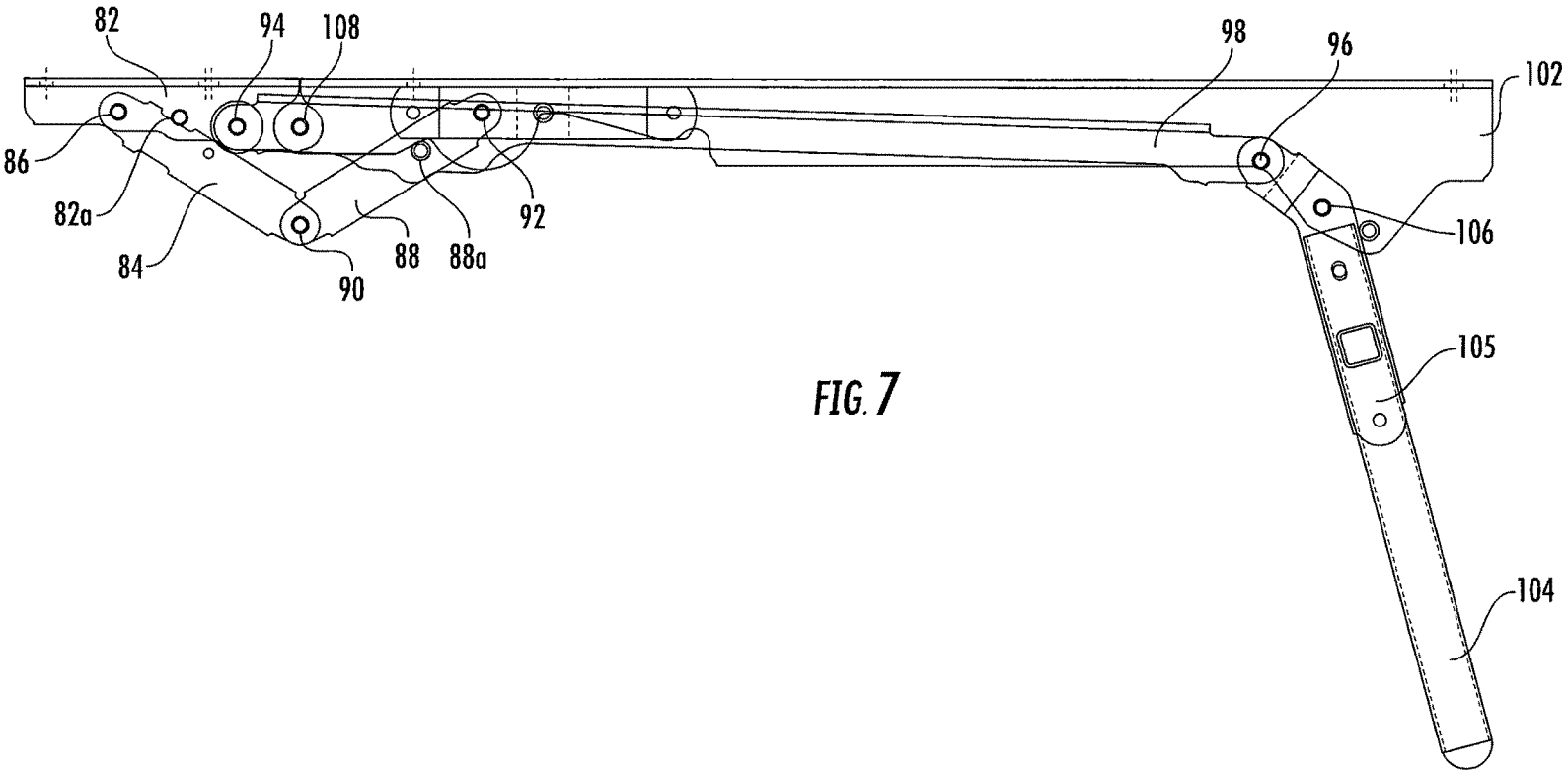
FIG. 7 is a side view of the leg folding mechanism of the seating unit of FIG. 1 in the unfolded position.

Still referring to FIG. 2 and also to FIG. 7, the leg folding mechanism 80 includes a front intermediate section bracket 82 mounted to the forward end of the intermediate section panel 22. A seat bracket 102 is mounted beneath and extends most of the length of the seat section panel 18. The seat bracket 102 is attached at its rear end to the front intermediate section bracket at a pivot 108. A leg 104 with an extension 105 is attached at a pivot 106 to the front end of the seat bracket 102 and extends downwardly therefrom. A connecting link 98 is attached to the upper end of the extension 105 at a pivot 96, and extends rearwardly to attach to the front intermediate section bracket 82 at a pivot 94. A scissor link 84 is attached to the front intermediate section bracket 82 at a pivot 86 and extends forwardly and downwardly therefrom. Another scissor link 88 is attached at one end to the lower end of the scissor link 84 at a pivot 90 and extends upwardly and forwardly to a pivot 92 with the seat bracket 102.

Figure 4:
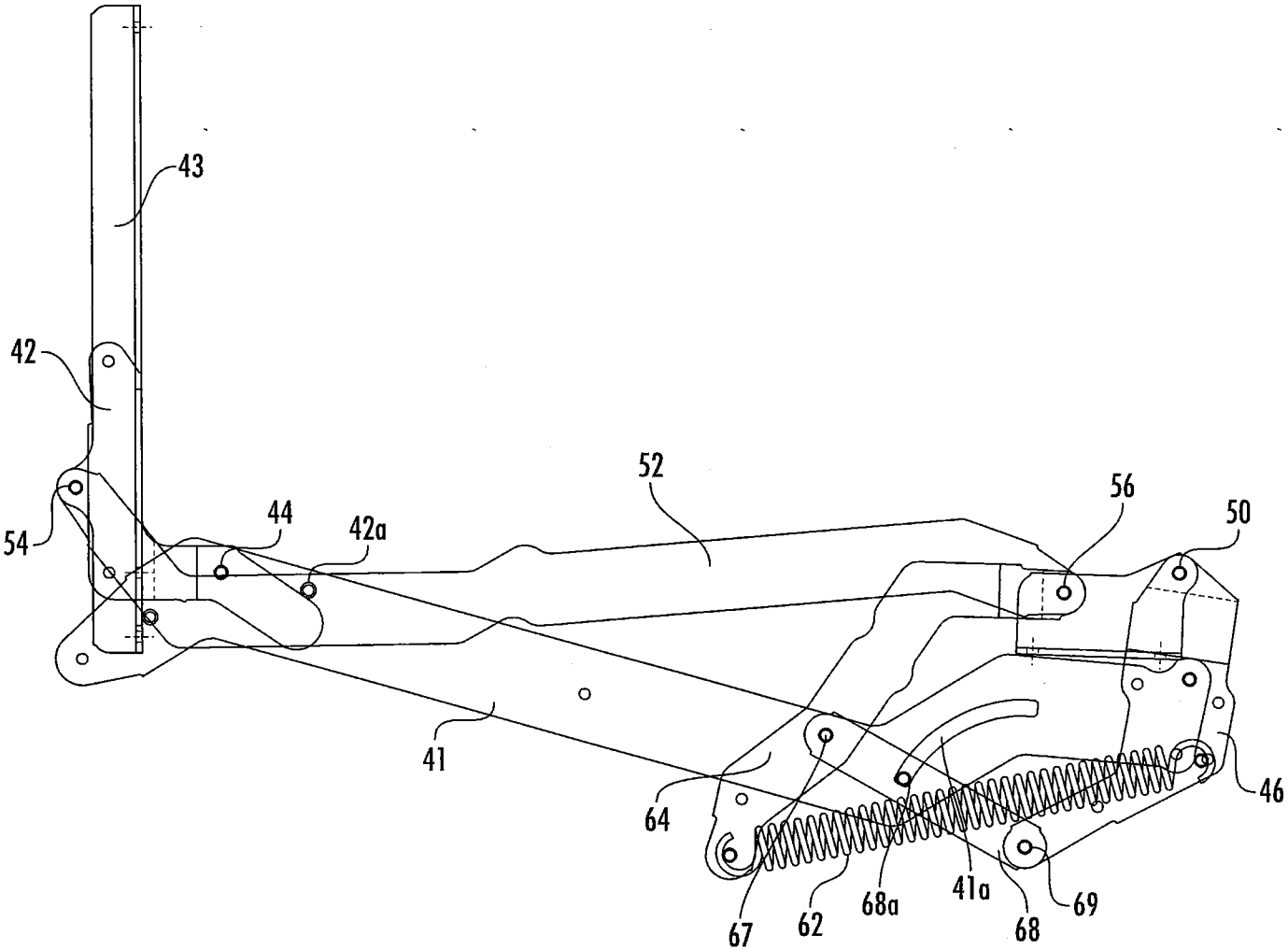
FIG. 4 is a side view of the bed folding mechanism of the seating unit of FIG. 1 in the folded position.
Figure 6:
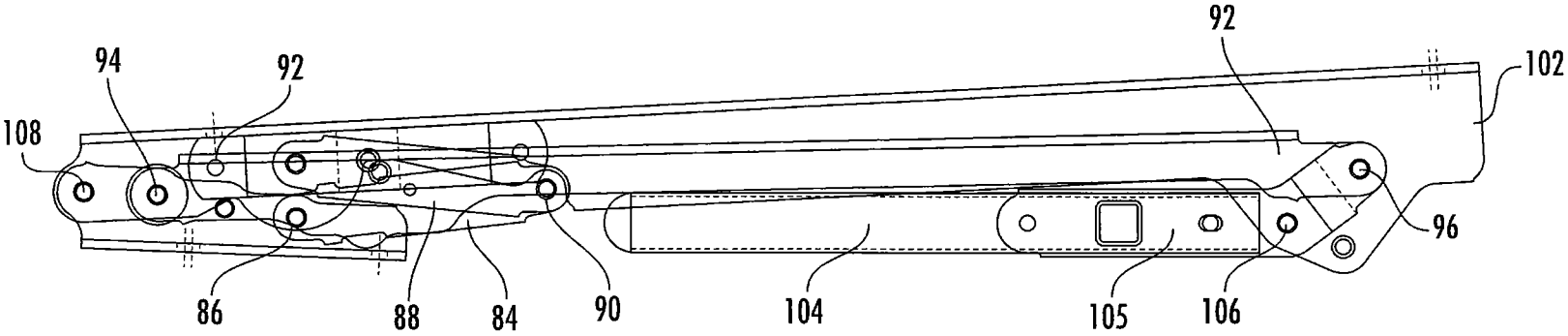
FIG. 6 is a side view of the leg folding mechanism of the seating unit of FIG. 1 in the folded position.

To move the bed 15 from the unfolded position of FIGS. 2, 3, 5 and 7 to the folded position of FIGS. 1, 4 and 6, a user lifts the front end of the seat section 16 and moves it rearwardly. This action also lifts the intermediate section 20, which, supported by the intermediate section bracket 48, begins to pivot relative to the base 11 (counterclockwise from the vantage point of FIGS. 2-4) about the pivot 50. The seat section 16 remains generally horizontal as the intermediate section 20 pivots relative to it about the pivot 108. The rotation of the intermediate section 20 also forces the connecting link 52 rearwardly, which drives the head section 24 to rotate counterclockwise about the pivot 44. This motion continues until the lower end of the head section link 42 contacts a pin 42*a* on the mounting bracket 41 (see FIG. 4), at which point the head section 24 has reached its rearmost position within the cavity 17 and is generally upright, with the outer surface 25 of the head section cushion 24*a* facing rearwardly and providing the visible rear surface of the seating unit 10 (see FIG. 1). Typically the panel 26 of the head section 24 is covered with loose cushions (shown in broken line at 27 in FIG. 1) to provide a comfortable backrest for a seated occupant of the seating unit 10.

Rotation of the intermediate section 20 about the pivot 50 ceases when it reaches an inverted orientation within the cavity 17, with its cushion 20*a* beneath the panel 22 (FIG. 1). The seat section 16 completes its motion in a generally horizontal but slightly pitched orientation (FIG. 1) in which a rail 18*a* mounted under the front end of the seat frame 18 rests atop the front wall 12.

It can further be seen in FIGS. 1, 2, 4 and 5 that, as the intermediate section 20 rotates counterclockwise about the pivot 50 and drives the connecting link 52 rearwardly, the spring link 64 of the unfolding assist assembly 60 is driven rearwardly and rotates slightly counterclockwise about the pivot 67 relative to the control link 68; in addition, the control link 68 rotates slightly counterclockwise about the pivot 69. The spring 62 develops very little tension during this initial portion of the folding action; however, continued rearward movement of the connecting link 52 forces the spring link 64 rearwardly, which continues the counterclockwise rotation of the control link 68. Rotation of the control link 68 stretches the spring 62, thereby generating some resistance to folding of the bed 15 (which can help to prevent dropping or "slamming" of the bed 15 as it closes due to its weight). Rotation of the control link 58 ceases when the pin 68*a* reaches the rear end of the slot 41*a* (FIGS. 1 and 4).

In addition, and referring to FIGS. 2, 6 and 7, as the seat section 16 rotates relative to the intermediate section 20 about the pivot 108, the connecting link 98 is forced forwardly relative to the seat section 16. This action drives then upper end of the extension 105 (and therefore the leg 104) clockwise about the pivot 106 relative to the seat bracket 102. The scissor links 84, 88 rotate relative to the pivots 86, 92 to collapse toward each other. In the folded position of FIGS. 1 and 6, the leg 104, connecting link 98, and scissor links 84, 88 are generally horizontal and folded between the seat panel 18 and the intermediate panel 22.

Unfolding of the bed 15 from the folded position of FIGS. 1, 4 and 6 to the unfolded position of FIGS. 2, 3, 5 and 7 is initiated by lifting the front edge of the seat section 16 and pulling it away from the base 11 of the seating unit 10. The bed folding mechanisms 30 and the leg folding mechanisms 80 reverse the movements described above to enable the bed 15 to unfold. Movement ceases when the rear edge of the head section link 42 strikes a pin 40*a* on the rear mounting bracket 40 (FIGS. 2 and 5). The folding resist assembly 60 assists in the unfolding operation until the control link 68 rotates clockwise sufficiently that the tension in the spring 62 is substantially absent. Also, the leg mechanism 80 is stabilized in the unfolded position by the upper edge of the scissor link 84 contacting a pin 82*a* on the front intermediate section bracket and by a pin 88*a* on the scissor link 88 contacting the lower edge of the seat bracket 102 (see FIG. 7).

The compact nature of the sofa 10 in the folded position makes it suitable for use in circumstances in which space may be at a premium. For example, recreational vehicles (e.g., RVs), trailers, mobile homes, studio apartments, hospitals, private aircraft, cruise ships and the like may benefit from the compact size of the folded sofa.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A seating unit that includes a foldable bed, the seating unit comprising:

a base with an internal cavity;

a foldable bed that includes separate and distinct head, intermediate and seat sections, wherein in a folded position, the intermediate and seat sections are generally horizontally disposed and positioned in vertically stacked relationship, and the head section is generally vertically disposed and positioned adjacent a rear portion of the base, with an outer surface of a cushion of the head section facing rearwardly to form a rear surface of the seating unit, and in an unfolded position, the head, intermediate and seat sections are generally horizontally disposed and in serial alignment with each other, with the outer surface of the cushion of the head section facing upwardly; and a bed folding mechanism that is attached to the base and the head, intermediate and seat sections that controls the movement of the bed between the folded and unfolded positions.

2. The seating unit defined in claim 1, wherein the head section pivots about a single pivot axis in moving between the folded and unfolded positions.

3. The seating unit defined in claim 1, wherein the intermediate section pivots about a single pivot axis in moving between the folded and unfolded positions.

4. The seating unit defined in claim 1, wherein the intermediate section and the seat section are pivotally attached to each other.

5. The seating unit defined in claim 1, wherein the head section cushion has a sloped front edge, and the intermediate section includes a cushion with a sloped rear edge.

6. The seating unit defined in claim 1, further comprising: (a) a leg pivotally attached to the seat section and (b) a leg folding assembly mounted to the intermediate section and the seat section, wherein the leg is configured to reside between the intermediate and seat sections when the seating unit is in the folded position and under the seat section when the seating unit is in the unfolded position.

7. The seating unit defined in claim 1, wherein the bed folding mechanism includes a folding resist unit that biases the bed toward the unfolded position.

8. A seating unit that includes a foldable bed, the seating unit comprising:

a base with an internal cavity;

a foldable bed that includes separate and distinct head, intermediate and seat sections, wherein in a folded position, the intermediate and seat sections are generally horizontally disposed and positioned in vertically stacked relationship, and the head section is generally vertically disposed and positioned adjacent a rear portion of the base, with a rear surface of a cushion of the head section facing rearwardly to form a rear surface of the seating unit, and in an unfolded position, the head, intermediate and seat sections are generally horizontally disposed and in serial alignment with each other, with the outer surface of the cushion of the head section facing upwardly; and a bed folding mechanism that is attached to the base and the head, intermediate and seat sections that controls the movement of the bed between the folded and unfolded positions;

wherein the head section pivots about a single pivot axis in moving between the folded and unfolded positions, and wherein the intermediate section pivots about a single pivot axis in moving between the folded and unfolded positions.

9. The seating unit defined in claim 8, wherein the intermediate section and the seat section are pivotally attached to each other.

10. The seating unit defined in claim 8, wherein the head section cushion has a sloped front edge, and the intermediate section includes a cushion with a sloped rear edge.

11. The seating unit defined in claim 8, further comprising: (a) a leg pivotally attached to the seat section and (b) a leg folding assembly mounted to the intermediate section and the seat section, wherein the leg is configured to reside between the intermediate and seat sections when the seating unit is in the folded position and under the seat section when the seating unit ism the unfolded position.

12. The seating unit defined in claim 8, wherein the bed folding mechanism includes a folding resist unit that biases the bed toward the unfolded position.

* * * * *